United States Patent [19]

Mersmann

[11] Patent Number: 5,056,168

[45] Date of Patent: Oct. 15, 1991

[54] WHIRLPOOL BATHTUB

[75] Inventor: Heinz-Werner Mersmann, Ahlen, Fed. Rep. of Germany

[73] Assignee: Franz Kaldewei GmbH & Co., Fed. Rep. of Germany

[21] Appl. No.: 490,689

[22] PCT Filed: Sep. 10, 1988

[86] PCT No.: PCT/DE88/00564

§ 371 Date: Mar. 16, 1990

§ 102(e) Date: Mar. 16, 1990

[87] PCT Pub. No.: WO89/02263

PCT Pub. Date: Mar. 23, 1989

[30] Foreign Application Priority Data

Sep. 16, 1987 [DE] Fed. Rep. of Germany ..... 3731084
Jan. 9, 1988 [DE] Fed. Rep. of Germany ..... 3800401

[51] Int. Cl.[5] ..... A61H 33/02
[52] U.S. Cl. ..... 4/542
[58] Field of Search ..... 4/492, 541, 542, 544

[56] References Cited

U.S. PATENT DOCUMENTS

| | | | |
|---|---|---|---|
| 4,559,653 | 12/1985 | Mathews | 4/541 |
| 4,561,133 | 12/1985 | Laing | 4/492 X |
| 4,665,572 | 5/1987 | Davidson et al. | 4/492 |
| 4,813,086 | 3/1989 | Henkin et al. | 4/542 |
| 4,829,607 | 5/1989 | Huse | 4/542 |
| 4,853,987 | 8/1989 | Jaworski | 4/542 |
| 4,907,304 | 3/1990 | Davidson et al. | 4/492 X |

FOREIGN PATENT DOCUMENTS

| | | | |
|---|---|---|---|
| 2209507 | 9/1973 | Fed. Rep. of Germany | 4/542 |
| 2713233 | 10/1978 | Fed. Rep. of Germany | 4/541 |
| 2919313 | 11/1980 | Fed. Rep. of Germany . | |
| 3720637 | 6/1988 | Fed. Rep. of Germany | 4/541 |
| 8804977 | 7/1988 | Fed. Rep. of Germany | 4/542 |
| 3716683 | 12/1988 | Fed. Rep. of Germany | 4/542 |
| 8802541 | 8/1989 | Netherlands | 4/542 |
| 2215599 | 9/1989 | United Kingdom | 4/542 |
| 8906120 | 7/1989 | World Int. Prop. O. | 4/541 |

*Primary Examiner*—Henry J. Recla
*Assistant Examiner*—Robert M. Fetsuga
*Attorney, Agent, or Firm*—Speckman & Pauley

[57] ABSTRACT

A whirlpool bathtub with fixtures for producing water and/or air jets, which can be delivered to the tub interior at a plurality of points on the tub wall and/or the tub bottom. No water-conduction pipe system underneath the bathtub is required and all parts of the whirlpool system are easily accessible for cleaning, if each one of these points on the tub wall and/or the tub bottom is assigned an individual, drivable fixture for producing a water and/or air jet. The fixture is set on the tub wall or the tub bottom or is built into the tub wall or the tub bottom and can be acted upon by driving energy from the exterior of the tub.

10 Claims, 1 Drawing Sheet

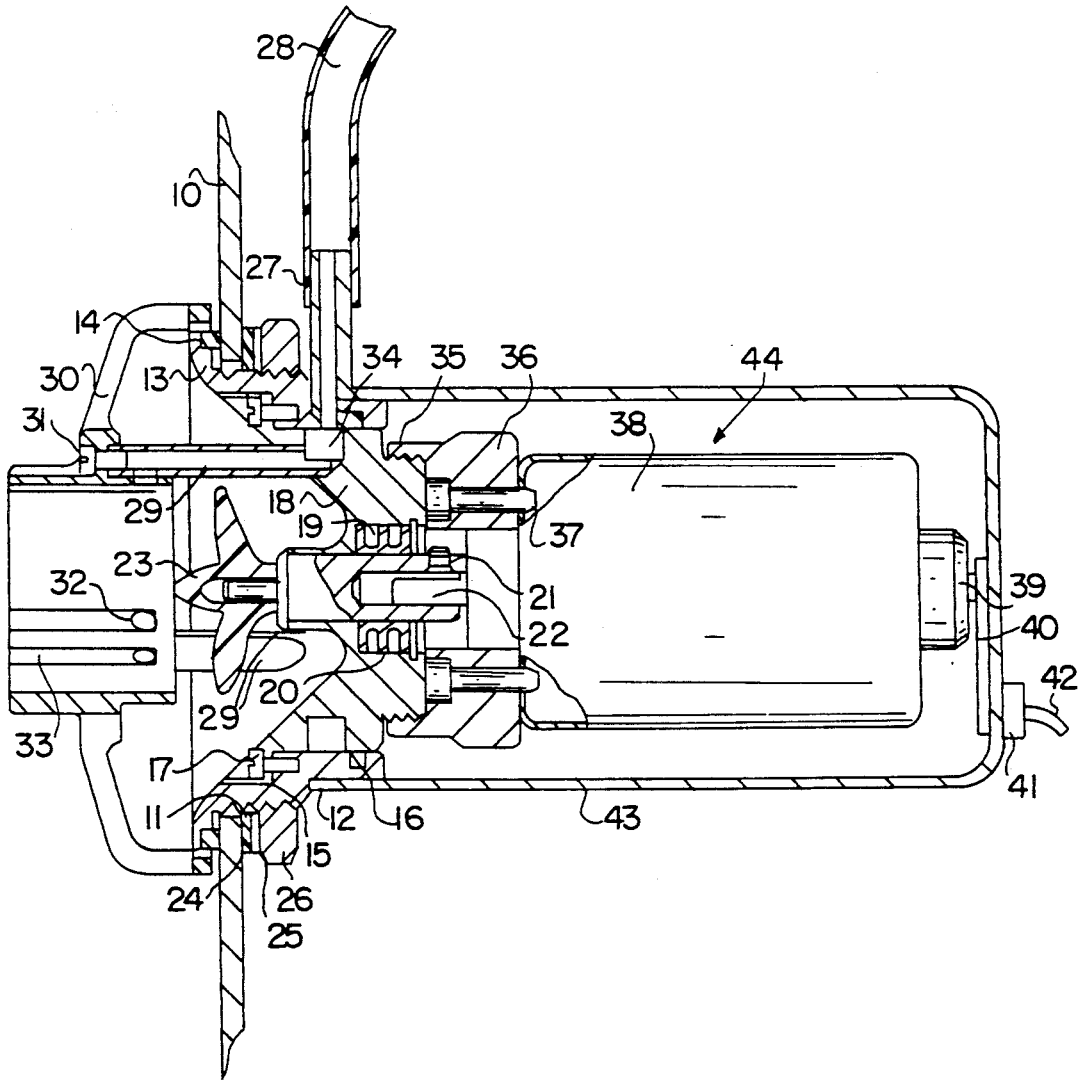
28
10
27
14
30
13
31
34
35
36
44
38
29
18
19
37
23
32
21
22
39
40
42
20
29
33
17
11
12
16
43
41
15
24
26
25

WHIRLPOOL BATHTUB

BACKGROUND OF THE INVENTION

1. Field of the Invention

The invention relates to a whirlpool bathtub with fixtures for producing jets of water and/or air, which can be delivered to the tub interior at a plurality of points on the tub wall, wherein each of these points is assigned an individual, drivable fixture for producing a jet of water and/or air; the fixture is attached to or built into the tub wall, is acted upon by driving energy from outside the tub, and has a fin that can be set into rotary motion or a propeller that can be set into rotary motion.

2. Description of the Prior Art

A whirlpool system of this type is taught by German Patent Document A 22 09 507. In this known whirlpool system, the fixtures for producing jets of water and/or air are built into the wall of a masonry basin and have a pump for aspirating water from the tub interior. This pump is a closed, compact component in which residual water remains in the pump housing after the pump has been shut off and water drained out of the tub; this residual water promotes the development of bacterial cultures. Therefore this whirlpool bathtub does not meet the hygienic requirements that such equipment is expected to meet.

SUMMARY OF THE INVENTION

It is accordingly an object of the invention, for a whirlpool bathtub of the above-described type, to create a fixture for producing streams of water and/or air in which no residual water for developing bacterial cultures remains after the fixture is shut off and the water is drained from the bathtub.

According to the invention, this object is achieved by providing a fin or propeller disposed in a chamber that is sealed in a watertight manner from the outside of the tub wall and is covered toward the tub interior by a nozzle screen having intake and outlet openings. The chamber is designed and connected to the tub wall in such a manner that when the bathtub is emptied, the chamber empties completely into the tub interior, through the nozzle screen having the intake and outlet openings.

Shifting the fin or propeller into the chamber that is sealed off from the outside of the tub and covered by the screen provides an installation that enables complete draining of the chamber into the tub interior through the screen. Residual water cannot stay in the chamber, which makes for substantially improved hygiene. Furthermore, once the screen is removed, the chamber having the fin or propeller can easily be cleaned and/or disinfected. This feature also provides easier maintenance of the system.

In accordance with an embodiment, the fixtures are each drivable with an electric motor, for producing a water jet, which is contained in the housing cup and which causes the propeller or the fin to perform rotating movements with its motor shaft. The intensity of the water jet can be easily varied by changing the rotational speed of the electric motor, in particular by changing the supply voltage.

In accordance with another embodiment, the type of operation of the whirlpool system can easily be changed by controlling the electric motors of the fixtures with a control device simultaneously and in the same way or, in the way of a program, differently and/or at different times. It thus possible to operate the nozzles simultaneously or at different times at the same or different intensity, so that it is possible to massage the parts of the body of the bather in different ways.

Admixture of air to the water jet can be achieved through venturi openings which are provided in the area of the nozzle, which are in contact above the maximum level of the water in the bathtub, with the ambient air. It is thus assured that no water can flow out through the venturi openings when the whirlpool system is shut off.

If the air supplied to the venturi openings of the nozzles is routed across a heating device and/or an ozone generator which can be simultaneously turned on and off with the fixtures, it is also possible to warm the admixed air and/or to enrich it with ozone.

The water-tight installation of the housing cup in the opening of the tub wall has been achieved in accordance with an embodiment, since the housing cup is fixedly connected with a housing ring, in the area of its open side, which extends over the opening in the tub wall with a flange. The flange is sealed towards the tub wall with a seal ring. The housing ring is fixed in the opening of the tub wall with a nut, with a sealing ring and a washer interposed, and in that the fixture is sealably inserted into the centered seat of the housing ring with sealing rings.

The sealed installation into the housing cup of a fixture operating as a part of a turbine has been provided in accordance with a further embodiment in such a way, that an annular seat is inserted into the housing ring. The propeller in a direction of a fixture, designed in the form of a turbine, is rotatably seated, facing the nozzle, with a propeller shaft, the propeller shaft is sealed in the annular seat by means of a sealing packet. On the end facing away from the nozzle the propeller shaft is connected with the motor shaft of an electric motor fixed against rotation. The electric motor is fastened on a motor flange, which is connected with the annular seat and faces away from the nozzle, and the electric motor is supported by a junction contact element, on a connector contact element, on the interior of the bottom of the housing cup. The connector contact element communicates with a supply cable extending through a cable lead-in. The connection between the motor flange and annular seat has been designed in such a way, that the motor flange ends in a propeller sleeve with an interior thread, which is screwed on an exterior thread of a collar of the annular seat.

In order to provide the operating space required for the propeller, in one embodiment the housing ring and the annular seat define a cone-shaped chamber behind the nozzle, into which the propeller of the turbine extends.

For the supply of air, an annularly extending annular chamber is fastened on the exterior of the annular seat which adjoins the housing ring. A hose nozzle is inserted into the housing ring and extends in a radial manner, which is connected with the annular chamber. Air supply sleeves are inserted into the annular seat, evenly spaced around the propeller and extending parallel to the propeller shaft, which are connected with the annular chamber and lead to the venturi openings in the nozzle. The nozzle is connected by screws with the annular seat through the air supply sleeves.

The design of the nozzle is such that the nozzle has a sleeve-like center part with the venturi openings, the diameter of which approximately corresponds to the diameter of the propeller. A cap element of the nozzle, pierced by radial slits, surrounds the flange of the housing element and is supported thereon.

The run-off of water from the bathtub through the air supply sleeves, the annular chamber, the hose nozzle and the air hose is prevented since an air hose is pushed onto the hose nozzle, the inlet opening of which is fixed on the outside of the bathtub in such a way that it is above the maximum level of water of the bathtub.

Heating and/or enrichment with ozone of the air supplied can be achieved since the air hoses of all fixtures are connected with each other and lead to a heating device and/or an ozone generator.

The simplest operation of the whirlpool system occurs if the control of the fixtures for producing the jet is performed in such a way that all connecting cables of the fixtures are switched in parallel and are connected with a control device for turning on and off and for controlling the electric motors.

The operation of the whirlpool system can be greatly varied in accordance with a further embodiment if all connecting cables of all fixtures are routed to a control device, which individually switches the electric motors of the fixtures on and off and controls them. The control device is positioned outside of the bathtub, so that its operation is easily accomplished.

The direction of the jet exiting the nozzle can be changed with the center part of the nozzle being partially pivotal in all directions.

So that the electric motors are not damaged or destroyed by penetrating moisture, a moisture warning switch is positioned in the housing cup, which reacts when moisture enters the housing cup and triggers an optical and/or acoustical trouble indication through a connecting line to the control device.

BRIEF DESCRIPTION OF THE DRAWINGS

The invention will be described in detail with one embodiment, shown in a partial cross-sectional view in the drawing.

DESCRIPTION OF THE PREFERRED EMBODIMENTS

The nozzle provided for each fixture is in the form of a turbine which produces a water jet to which air is admixed in the area of the nozzle, in accordance with the venturi principle.

The section shows a portion of the tub wall 10 with an opening 11. In a known manner, the bathtub can have such openings 11 at several points of the tub wall 10, into which in the same way a fixture 44 for producing a water jet has been built. The housing cup 43 is connected with the housing ring 12 on its open end, the latter extending over the opening 11 with its flange 13. The sealing ring 14 is inserted on the underside of the flange 12 and seals it against the tub wall 10. The housing ring 12 extends through the opening 11 with an exterior thread. The nut 26 is screwed onto the exterior thread of the housing ring 12, with the sealing ring 24 and the washer 25 interposed, so that the housing cup 43 closes the opening 11 in a water-tight manner. The centered seat of the housing ring 12 receives the annular seat 18, the sealing rings 15 and 16 sealing the joined surfaces. The annular seat 18 is fixedly connected by the fastening screws 17 with the housing ring 12. The annular seat 18 receives the propeller shaft 20, which is rotatably supported and sealed by the sealing packet 19. The propeller shaft 20 supports the propeller 23 located in the working chamber formed by the seat of the housing ring 12, in the shape of a truncated cone, and the annular seat 18 on the side facing the nozzle 30. The propeller shaft 20 is fixed, secure against rotation, on the motor shaft 22 of the electric motor 38 with the set screw 21. The electric motor 38 is fixedly connected with the motor flange 36 by fastening screws 37. The motor flange 36 ends in a sleeve with an interior thread, by means of which it is screwed onto the collar of the annular seat 18, which has an external thread, as shown by the screw connection 35. The electric motor 38 has, on the face oriented away from the nozzle 30, the junction contact element 39, which is supported by a connector contact element 40 positioned on the interior of the bottom of the housing cup 43. The contacts of the connector contact element 40 are connected with the connecting cable 42, which has been inserted into the housing cup 43 by the cable lead-in 41. It is possible to additionally dispose a moisture warning switch which reacts to penetrating moisture in the housing cup 43. A connecting line, inserted into the housing cup 43, in a manner similar to the connecting cable 42, leads to the control device, which triggers an optical and/or acoustical trouble indication when the moisture warning switch reacts.

The nozzle 30 is comprised of the sleeve-like center part, the diameter of which approximately corresponds to the diameter of the propeller 23. The cap portion, supplied with radially extending slits, is adapted to the center part and surrounds the flange 13 of the housing ring 12. The venturi openings 32 are disposed in the center part, distributed over its circumference, and end in grooves routed to the front of the center part. The air supply sleeves 29 are fixed in the cap part of the nozzle 30, as shown by the fastening screws 31. The air supply sleeves 29 are open towards the venturi openings 32. The air supply sleeves 29 are fixed in the annular seat 18 and are in communication with the annular chamber 34. The annular chamber 34 has been disposed in the exterior of the annular seat 18 in the form of a circumferential groove and is completed by the adjoining wall of the housing ring 12. The sealing rings 15 and 16 seal the annular chamber 34 on both sides. The hose nozzle 27, which is in communication with the annular chamber 34, is radially inserted into the housing ring 12. The air hose 28 is placed on the hose nozzle 27 and is positioned and fastened on the outside of the bathtub with its input opening sufficiently high so that it lies above the maximum level of the water in the bathtub.

When the electric motor 38 is switched on, the propeller 23 rotates and thus water is aspirated through the slits in the cap part of the nozzle 30 and expelled as a jet through the center part. On the basis of the venturi principle, air is aspirated through the venturi openings 32 in the course of this and admixed to the water jet. The fixture 44 can also be designed without air supply sleeves 29, annular chamber 34 and hose nozzle 27, and without venturi openings 32 in the nozzle 30, only for producing a water jet. The fixture 44 can also be designed as a blower which supplies a jet of air to the nozzle 30, for example by means of a backflow valve. After removal of the nozzle 30, the fixture 44 can be easily removed from the housing cup 43 and exchanged, if required. Cleaning of the surfaces which are in contact with water is also easily possible after removal of the nozzle 30.

The air hoses 28 of all fixtures 44 can also easily be routed to a central heating device and/or an ozone generator, so that the supplied air can be heated and/or enriched with ozone.

Each electric motor 38 of the fixtures 44 can be individually switched on or off and controlled by the connecting cables 42. If all connecting cables 42 are switched in parallel, all fixtures 44 are simultaneously switched on or off and controlled, a change in the supply voltage, for example, resulting in a change in the rotational speed of the electric motor 38.

However, the connecting cables 42 can also be routed individually to the central control device and from there individually switched on and off and controlled. It is possible to pre-select a program at the control device, which presets the times for switching on and off the individual fixtures 44 as well as the intensity of the produced jet. In connection with this, the fixtures 44 with electric motors 38 are operated at a safe low voltage for which, for reasons of controllability, direct voltage is preforably selected.

I claim:

1. In a whirlpool bathtub with fixtures (44) for producing jets of at least one of water and air, which can be delivered to an interior of the bathtub at a plurality of points on a tub wall (10), each said point on the tub wall having a cup-shaped housing mounted through an opening in the tub wall with an open end thereof directed into the tub and having an individual, drivable fixture (44) mounted in said housing, where each said fixture is individually drivable by a motor activated by driving energy from outside of the bathtub, and has a propeller (23) which can be set into rotating motion by said motor, the improvement comprising: a truncated cone-shaped seat sealingly mounted within said housing adjacent said open end thereof, said truncated cone-shaped seat positioned such that an apex thereof is directed towards a closed end of said housing and an opposite end thereof defines a propeller chamber, said propeller (23) positioned in said chamber and being mounted on a shaft sealingly mounted through an aperture in said apex of said seat and connected to said motor, a nozzle cover (30) mounted on said open end of said housing and having aspirating openings (34) and exit openings (33), whereby water in said chamber empties completely through said nozzle cover (30) when the bathtub is emptied.

2. In a whirlpool bathtub in accordance with claim 1, wherein said housing cup (43) open end is fixedly connected to a housing ring (12) extending through said tub wall opening and having a flange (13) extending over said opening, said flange (13) being sealed towards said tub wall (10) with a first sealing ring (14), said housing ring (12) being fixed with a nut (26) in said opening (11) of said tub wall (10) through interposition of a second sealing ring (24) and a washer (25), and said seat being sealingly inserted with third and fourth sealing rings (15, 16) into said housing ring (12).

3. In a whirlpool bathtub in accordance with claim 2, wherein said propeller shaft (20) is sealed in said seat (18) with a sealing packet (19), said motor (38) being fastened on a motor flange (36) which is connected to said seat (18) and faces away from said nozzle cover (30), said motor (38) being supported by a junction contact element (39) engaging a connector contact element (40) mounted on an interior of said closed end of said housing cup (43), and said connector contact element (40) communicates with a connecting cable (42) extending through a cable lead-in (41).

4. In a whirlpool bathtub in accordance with claim 3, wherein said motor flange (36) ends in a screw sleeve with an interior thread which is screwed on an exterior thread of a collar of said seat (18).

5. In a whirlpool bathtub in accordance with claim 4, wherein an annular groove (34) is formed in an exterior surface of said seat (18) which is closed by said housing ring (12) to form an annular chamber, a hose nozzle (27) inserted through an aperture in said housing ring (12) in communication with said annular chamber and extending in a radial manner, said seat (18) having a plurality of air supply sleeves (29) evenly spaced around said propeller (23) and extending parallel to said propeller shaft (20), said sleeves being in communication with said annular chamber (34) and in communication with a plurality of venturi openings (32) in said nozzle cover (30), and said nozzle cover (30) being connected by screws (31) engaging said air supply sleeves (29).

6. In a whirlpool bathtub in accordance with claim 5, wherein a rotational speed of said motor (38) is controlled by changing the driving energy thereto.

7. In a whirlpool bathtub in accordance with claim 6, wherein said venturi openings (32) are in a region of said exit opening (33) said nozzle cover (30) and in communication with ambient air through said hose nozzle.

8. In a whirlpool bathtub in accordance with claim 7, wherein said nozzle cover (30) has a sleeve-like center part having said venturi openings (32) therein, an opening diameter of said sleeve-like center part approximately corresponds to a diameter of said propeller (23), and a cap element of said nozzle cover (30) is pierced by a plurality of radial slits and surrounds said flange (13) of said housing ring (12) and is supported thereon.

9. In a whirlpool bathtub in accordance with claim 5, wherein an air hose (28) is pushed onto said hose nozzle (27), and an inlet end of said hose is above a maximum level of water in the bathtub.

10. In a whirlpool bathtub in accordance with claim 9, wherein said air hose (28) of each said fixture (44) communicate with each other.

* * * * *